US010134244B1

(12) United States Patent
Holbrook

(10) Patent No.: US 10,134,244 B1
(45) Date of Patent: Nov. 20, 2018

(54) LOTTERY TICKET DISPENSER BIN WITH PIVOTAL DOOR

(71) Applicant: Scientific Games International, Inc., Newark, DE (US)

(72) Inventor: James Jonathan Holbrook, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

(21) Appl. No.: 15/969,823

(22) Filed: May 3, 2018

(51) Int. Cl.
*G07F 17/42* (2006.01)
*G07F 17/32* (2006.01)

(52) U.S. Cl.
CPC ..... *G07F 17/42* (2013.01); *G07F 17/329* (2013.01)

(58) Field of Classification Search
None
See application file for complete search history.

(56) References Cited

U.S. PATENT DOCUMENTS 4,336,894 A * 6/1982 Crye ..... B65D 83/10 221/280
4,516,711 A * 5/1985 Barege ..... A47K 10/34 225/20
4,858,806 A * 8/1989 Schafer ..... G07B 3/04 225/32
4,995,507 A * 2/1991 Schafer ..... A47K 10/426 206/39
5,100,038 A * 3/1992 Schafer ..... A47K 10/426 225/32
5,222,624 A * 6/1993 Burr ..... G07C 15/005 221/1
5,287,980 A * 2/1994 Saltz ..... G07B 3/04 206/509
5,399,005 A * 3/1995 Schafer ..... G07B 3/04 206/509
6,095,624 A * 8/2000 Wilbert ..... G07B 3/04 312/293.3
7,467,738 B2 12/2008 Woods et al.
7,665,394 B2 2/2010 Roberts et al.
7,850,257 B2 12/2010 Roberts et al.
9,613,337 B1 * 4/2017 Garrison ..... G06Q 10/087
2005/0173447 A1 8/2005 Jensen
2006/0016826 A1 * 1/2006 Jensen ..... G07B 3/04 221/199
2007/0088459 A1 4/2007 Pollard et al.
2014/0346187 A1 * 11/2014 Barrett ..... E05B 63/14 221/154
2016/0155275 A1 * 6/2016 Barrett ..... B65H 3/24 221/155
2016/0335810 A1 11/2016 Barrett et al.

* cited by examiner

*Primary Examiner* — Gene O Crawford
*Assistant Examiner* — Ayodeji T Ojofeitimi
(74) *Attorney, Agent, or Firm* — Dority & Manning, P.A.

(57) ABSTRACT

A lottery ticket dispenser bin includes a pivotal door configured on a housing and movable between a fully closed position and a fully open position relative to the housing. The pivotal door includes a back wall and a bottom frame mounted to the housing. One or more spring-loaded, elongated tabs are pivotally mounted to the bottom frame and extend transversely from the bottom frame and are biased against the back wall of the door. The tabs have a length so as to be continuously engaged against the back wall as the pivotal door moves between the fully open and fully closed positions to define a bridge that prevents the lottery tickets from moving into a hinge area between the housing and the pivotal door.

9 Claims, 4 Drawing Sheets

LOTTERY TICKET DISPENSER BIN WITH PIVOTAL DOOR

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

For example, U.S. Pat. No. 9,339,121 proposes an electronic lottery ticket dispensing system that includes a plurality of lockable ticket compartments that each dispenses a ticket upon receipt of a dispense trigger signal from a computing device. Inside each ticket compartment resides a dispensing mechanism and an associated motor that actuates the dispensing mechanism. The dispensing mechanism advances at least one ticket from a continuous perforated fan fold of scratch-off lottery tickets. With this system, the compartments are arranged side-by-side within a drawer that slides into a cabinet. To load new ticket packs, the drawer is slid out from the cabinet and the ticket packs are inserted from above into each respective compartment.

U.S. Pat. Application Pub. No. 2017/0018148 describes a lottery ticket dispenser array having a plurality of individual interconnected individual bins, wherein each bin includes a multi-sided housing in which a pack of lottery tickets is stored. The stacked tickets are interconnected by a perforation line between adjacent tickets and a drive mechanism and scanner are configured within each bin. Upon receipt of a purchase signal, the drive mechanism dispenses the requisite number of tickets out of a slot in a back face or wall of the bin as the scanner reads the code printed on the ticket as it passes through the slot. The drive mechanism, dispensing slot, and control electronics are housed within the back wall, which is configured as a door that pivots between a fully closed position and a fully open position relative to the housing in order for an operator to load new ticket packs into the bin.

With the type of dispenser array wherein the individual bins (or two or more adjacent bins) have a pivotable door, as with the '148 application discussed above, a problem exists in that the bottom ticket layers tend to shift upon loading the ticket packs into the bin and can move into the area of the hinge line between the door and the compartment frame. When this occurs, the tickets jam the hinge line and prevent the door from closing. In addition, the tickets can become damaged (e.g., bent or torn) along the edges facing the door when the operator attempts to close the door, which may result in a subsequent dispensing jam when the ticket is engaged by the drive mechanism and fed through the dispensing slot.

The present invention seeks to provide a pivotal door for one or more adjacent dispensing bins that minimizes the risk of tickets becoming lodged in the hinge area of the door.

SUMMARY

Objects and advantages of the invention will be set forth in part in the following description, or may be obvious from the description, or may be learned through practice of the invention.

In accordance with aspects of the invention, a bin is provided for receipt and dispensing of pre-printed lottery tickets, such as conventional interconnected scratch-off lottery tickets. The individual bins are configured for use in a dispenser array, for example an array of 3×4 separate bins, wherein each bin is defined by a housing having a front side that faces a purchaser in operational use of the dispenser array, and an opposite back side that faces the retail vendor or clerk. Each bin defines one or more compartments for receipt of a supply of interconnected lottery tickets in each compartment, such as a fan-folded stack or roll of interconnected lottery tickets. Each bin may contain a supply of different scratch-off lottery ticket games, or two or more bins may contain a respective supply of tickets for the same game. Each compartment includes an electronic drive mechanism that dispenses the lottery tickets through a dispensing slot in the back side of the bin.

Each bin includes a pivotal door configured on the housing, wherein the door defines the back side of the bin. The pivotal door is movable between a fully closed position and a fully open position relative to the housing to allow the retail clerk to load new ticket packs into the compartment(s).

The pivotal door is uniquely configured in accordance with aspects of the invention. The door includes a back wall that faces the compartment and may have a generally arcuate shape. The door also includes a bottom frame member mounted to the housing, wherein the door pivots relative to the bottom frame member.

One or more spring-loaded, elongated tabs are pivotally mounted to the bottom frame and extend transversely from the bottom frame and are biased against the back wall. The elongated tab has a length so as to be continuously engaged against the back wall as the pivotal door moves between the fully open and fully closed positions. In this manner, the elongated tab defines a bridge that prevents the lottery tickets from moving into a hinge area between the housing and the pivotal door and causing a jam or other condition that prevents the door from closing.

In a particular embodiment, a plurality of the elongated tabs are spaced apart along the bottom frame, with each compartment in the bin having two more of the tabs configured therewith.

In one embodiment, the bottom frame includes arms at opposite ends thereof that releasably engage with the housing to mount the bottom frame to the housing. With this configuration, the entire pivotal door is readily removable from the housing (and array cabinet) and is replaceable or interchangeable with other doors in the array or a new door.

The elongated tabs may be variously configured. In a particular embodiment, the tabs have a length and shape such that, in the fully closed position of the pivotal door, the elongated tab assumes a substantially vertical position within the housing compartment.

In a desirable embodiment, the back wall has a first rib defined thereon that extends transversely from the wall. The elongated tab is biased against the first rib and slides against the rib as the door is moved between the fully closed and fully open positions. Thus, the first rib presents a minimal frictional contact surface to the elongated tab.

The first rib may be flanked by a pair of spaced-apart second ribs that extend transversely from the back wall of the door beyond the first rib. These second ribs are spaced-apart such that the elongated tab slides against the first rib between the second ribs. With a further feature of this embodiment, in the fully closed position of the pivotal door, the elongated tab may be biased against the first rib and assume a substantially vertical position within the housing, and the second ribs may be coplanar with the elongated tab along at least an upper portion of the elongated tab.

A plurality of the first rib and flanking second ribs combination may be configured along the back wall.

The present invention encompasses any manner of lottery ticket dispenser array having one or more of the dispenser bins as embodied herein.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
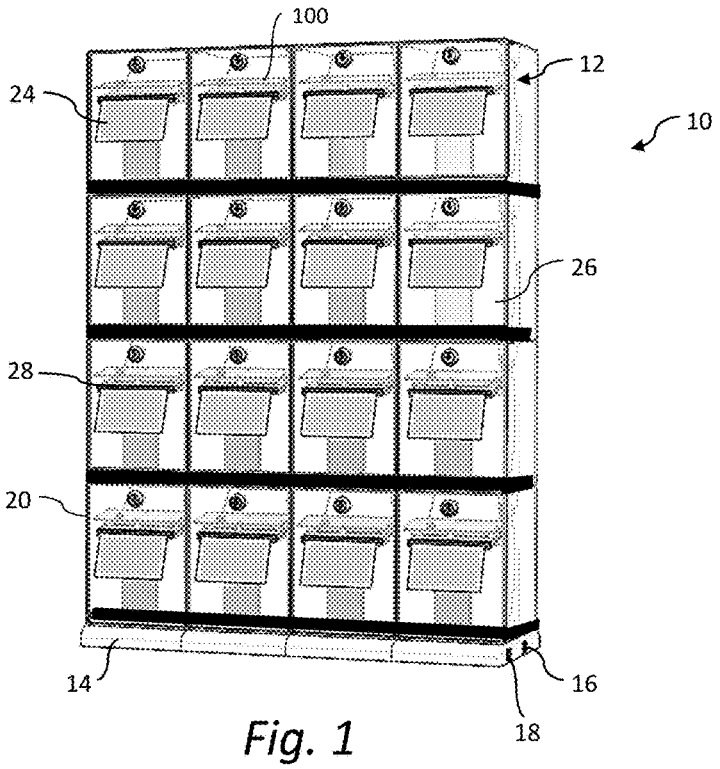
FIG. 1 is a front perspective view of a conventional lottery ticket dispenser array that includes a plurality of individual ticket bins.

FIG. 1 depicts a lottery ticket dispenser array 10 that includes a plurality of individual dispenser bins 12 in a stacked configuration. The architecture of each bin 12 and the overall array 10 can vary within the scope of the invention. For example, as depicted in FIG. 1, the dispenser array 10 may include a bottom row of bins 12 having interconnected base structures 14. Each base structure 14 may include a male power plug and male data plug along one side (not visible in FIG. 1), and a female power port 16 and female data port 18 along the opposite side. The plugs and ports of adjacent base structures 14 interconnect to essentially define a data bus running the length of the base structures 14. An exposed power port 16 and data port 18 at one of the ends of the interconnected base structures 14 is available for connection with a power cord and a data cord from a system controller or lottery terminal 20.

Each of the individual bins 12 includes a multi-sided housing 20 defining an internal space in which one or more compartments are defined. A stack or roll of lottery tickets 24 is stored in each compartment for subsequent dispensing through a dispensing slot 28. The lottery tickets 24 may be, for example, conventional instant scratch-off lottery tickets provided in the form of a stack of interconnected tickets 24. In the depicted embodiments, the housing 20 is a box-like structure having top and bottom walls, side walls 22, a front wall that faces outward towards a ticket purchaser, and a pivotal back wall or panel 26 that swings open to provide access into the housing 20 for loading the ticket stack. Each bin 12 may include a male power/data connector on the top or bottom surface, and a corresponding female power/data connector on the opposite surface so that a plurality of the bins 12 can be vertically stacked and interconnected, as depicted in FIG. 1.

Figure 2:
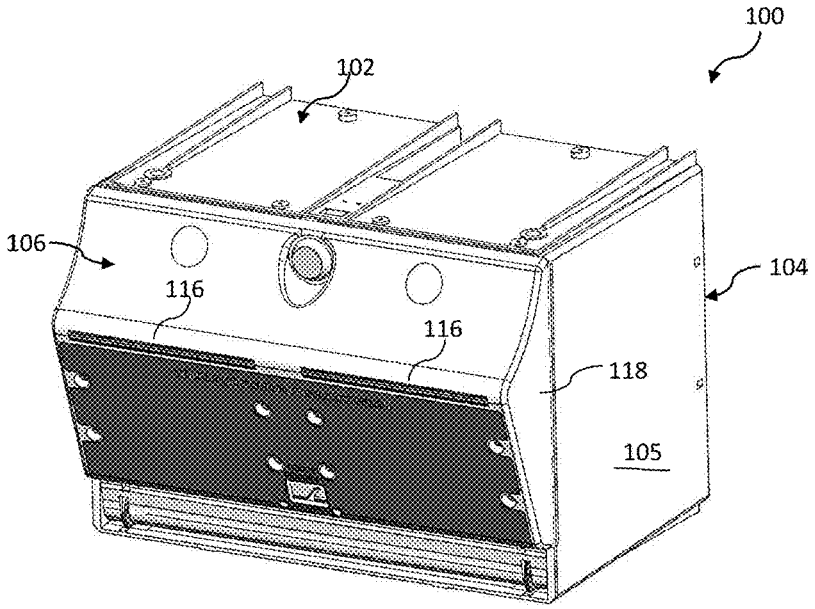
FIG. 2 is a front perspective view of an embodiment of a lottery ticket dispenser bin in accordance with aspects of the invention.

FIG. 2 depicts an embodiment of a lottery ticket dispensing bin 100 that may be used with as a component of a dispenser array, such as the array 10 in FIG. 1. The bin 100 is configured for receipt and dispensing of pre-printed lottery tickets, such as conventional interconnected scratch-off lottery tickets, as discussed above. The individual bin 100 is defined by a housing 102 having a front side 104 that faces a purchaser in operational use of the dispenser array, and an opposite back side 106 that faces the retail vendor or clerk. Each bin 100 defines one or more compartments 108 for receipt of the stack of interconnected lottery tickets in each compartment 108, such as a fan-folded stack or roll of interconnected lottery tickets. Each bin 100 may contain a supply of different scratch-off lottery ticket games, or two or more bins may contain a respective supply of tickets for the same game.

Figure 3:
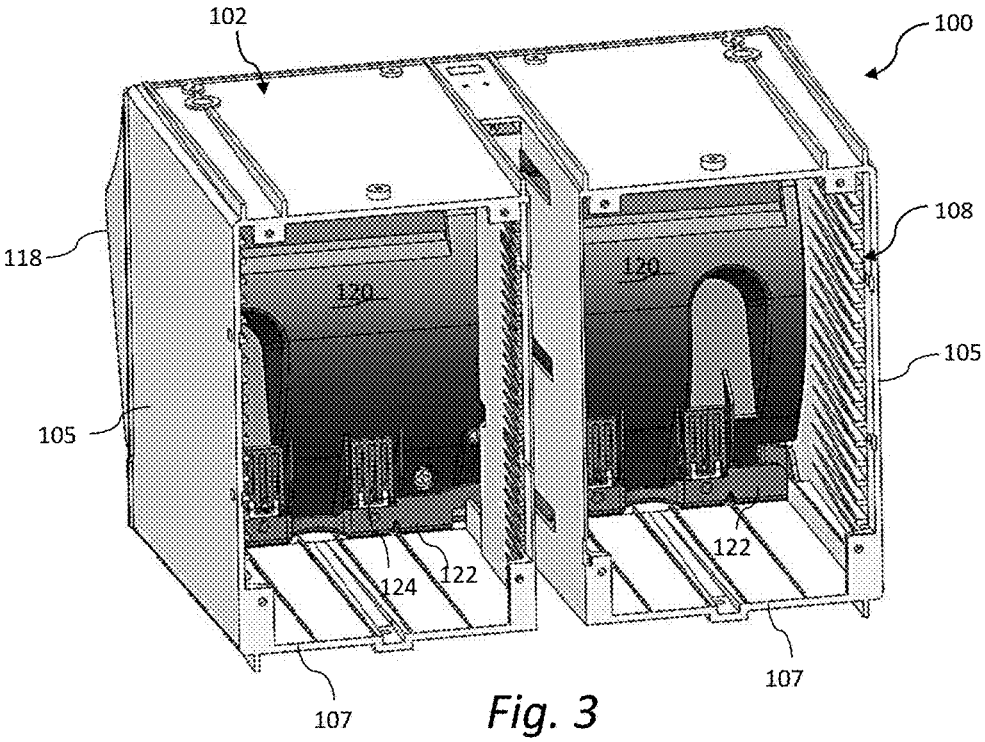
FIG. 3 is a back perspective view of the dispenser bin of FIG. 2.

In the embodiment of FIG. 2, the bin 100 is configured with two internal compartments 108, as seen in FIG. 3, wherein the compartments 108 share a common front side 104 defined by a pivotal door 118 (discussed in greater detail below). Each compartment may have its own set of sides 105 and individual bottom wall 107, as depicted in FIG. 3. Alternatively, adjacent compartments 108 within the same bin 100 may not have a dividing wall therebetween and may share a common bottom wall 107. It should also be appreciated that the bin 100 may be configured with a single compartment 108 having its own pivotal door 118, sides 105 and bottom wall 107.

Figure 6:
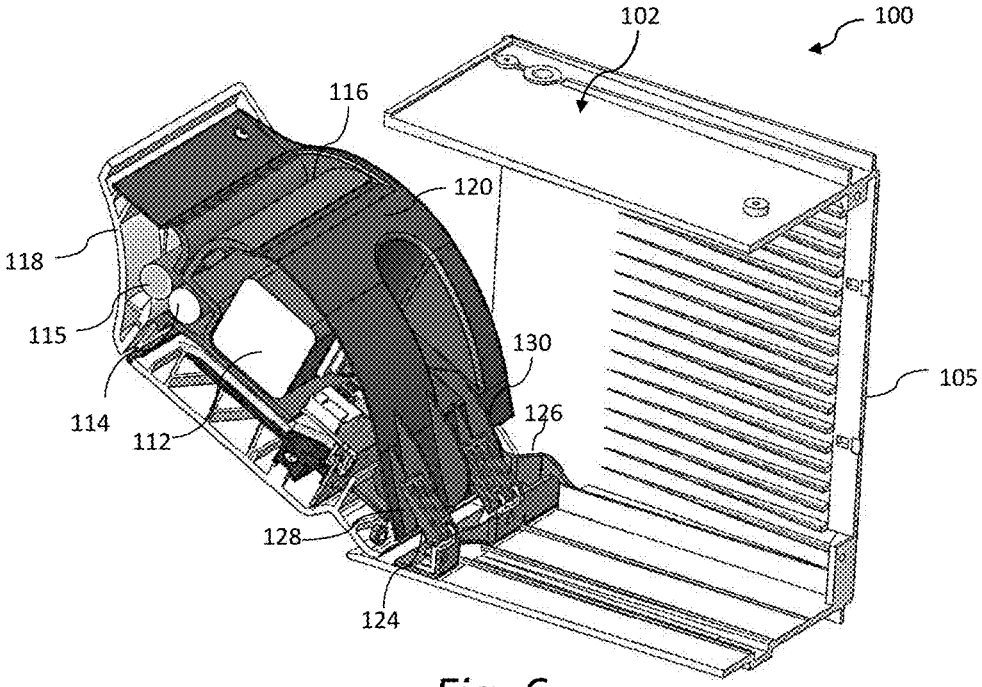
FIG. 6 is a side perspective view of the pivotal door assembly of FIG. 4 in an intermediate position relative to the bin housing.
Figure 7:
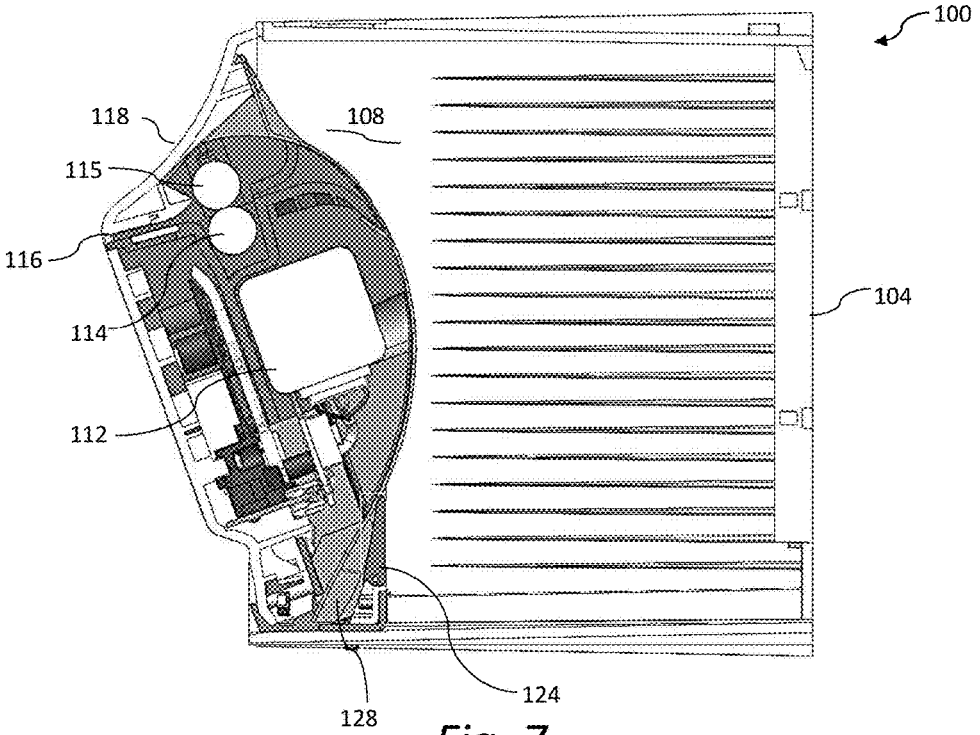
FIG. 7 is a side cut-away view of the pivotal door assembly and housing of FIG. 6.
Figure 8:
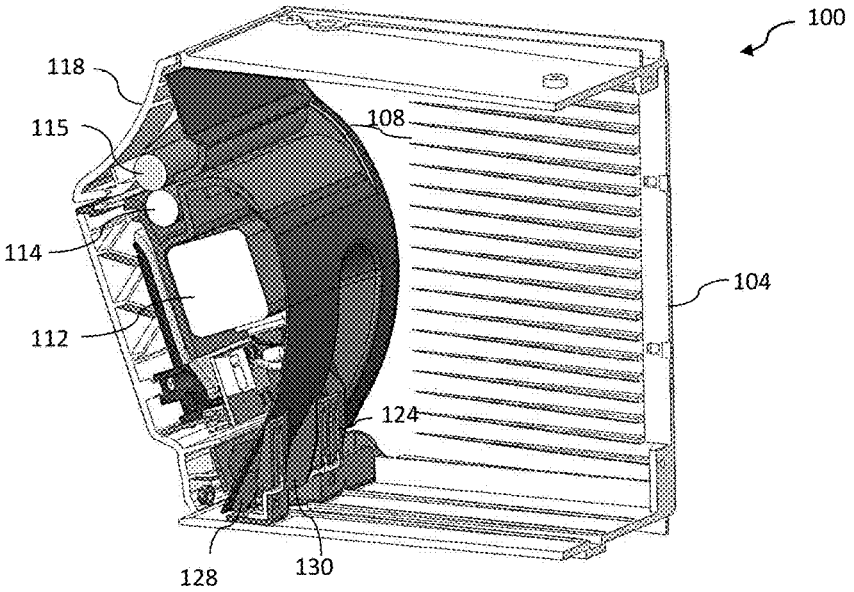
FIG. 8 is a side perspective and cut-away view of the pivotal door assembly and housing of FIG. 7.

Referring to FIGS. 6 through 8, each individual compartment 108 includes an electronic drive mechanism that dispenses the lottery tickets through a dispensing slot 116 in the back side 106 of the pivotal door 118. This drive mechanism may be variously configured. For example, in the depicted embodiment, the drive mechanism includes a motor 112 that is operatively connected to a drive roller 114 that forms a nip with an opposite idler roller 115. The leading lottery ticket is conveyed through this nip and driven out through the dispensing slot 116 by the drive roller 114. The drive mechanism may be contained within the pivotal door 118, as depicted in the figures, or may be mounted in the housing 102 (e.g., within the individual compartment 108).

Figure 5:
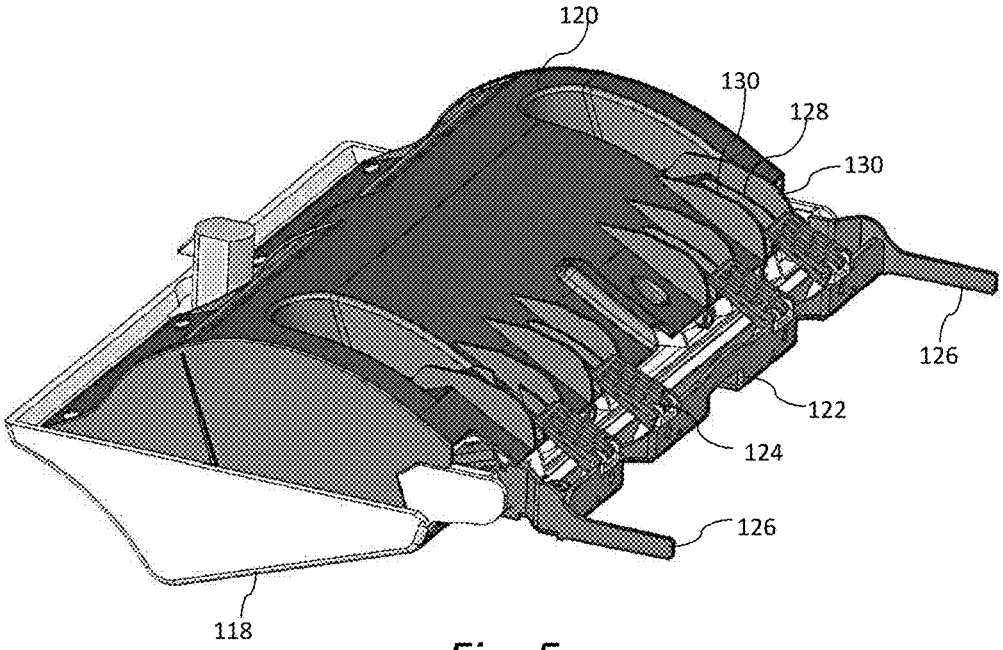
FIG. 5 is a side perspective view of the pivotal door assembly of FIG. 4.

Referring the figures in general, the pivotal door 118 is movable between a fully closed position (FIGS. 7 and 8) and a fully open position relative to the housing 102 to allow the retail clerk to load new ticket packs into the compartment(s) 108. FIG. 5 depicts orientation of the pivotal door 118 in the fully open position, and FIG. 6 shows the pivotal door 118 in an intermediate position relative to the housing 102.

The pivotal door 118 includes a back wall 120 that faces the compartment 108 and may have a generally arcuate shape as shown in the figures to accommodate the drive mechanism (motor 112 and rollers 114, 115) as well as a scanner and control components associated with the bin 100. The pivotal door 118 also includes a bottom frame member 122 that releasably mounts or attached to the housing 102, wherein the door 118 pivots relative to the bottom frame member 122. This configuration allows the entire pivotal door 118 to be readily removable from the housing 102 for repair or replacement.

One or more spring-loaded, elongated tabs 124 are pivotally mounted and spring-loaded to the bottom frame member 122. These tabs 124 extend transversely from the bottom frame member 122 and are each individually biased (e.g., spring-loaded) against the back wall 120 in order to keep constant contact with the wall 120 in all opening angles of the pivotal door 118. The elongated tabs 124 have a length so as to be continuously engaged against the back wall 120 as the pivotal door 118 moves between the fully open and fully closed positions, as depicted in the figures. In this manner, the elongated tabs 124 define a bridge across the open hinge area between the pivotal door 118 and housing 102 that prevents the lottery tickets from moving into the hinge area and causing a jam or other condition that prevents the door from closing.

In the depicted embodiment, a plurality of the elongated tabs 124 are spaced apart along the bottom frame member 122, with each compartment 108 in the bin 100 having two more of the tabs 124 configured therewith.

Figure 4:
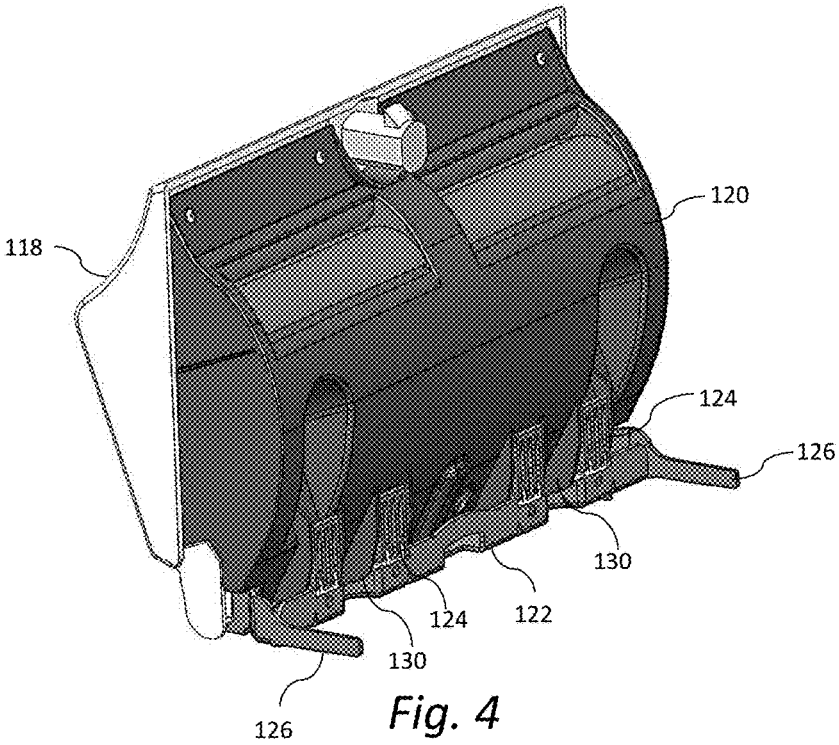
FIG. 4 is a back perspective view of a pivotal door assembly from the dispenser bin of FIG. 2.

Referring particularly to FIGS. 4 and 5, the bottom frame member 122 may include opposite arms 126 at the opposite ends thereof that releasably engage with a bottom wall of the housing 102 at each compartment to mount the bottom frame 122 (and pivotal door 118) to the housing. For example, the arms 126 may slide and lock into grooves within the housing 102. With this configuration, the entire pivotal door 118 is readily removable from the housing (and array) and is replaceable or interchangeable with other doors 118 in the array.

The elongated tabs 124 may be variously configured. In the illustrated embodiment, the tabs 124 have a length and shape such that, in the fully closed position of the pivotal door depicted in FIGS. 7 and 8, the elongated tabs 124 assumes a substantially vertical position within the housing compartment. This configuration presents little to no interference with the tickets within the compartment 108 during the dispense sequences, particularly if the tabs 124 are disposed essentially "under" the arcuate portion of the back wall 120 that extends into the compartment 108. In other words, the tabs 124 are vertical and at a location that does not extend as far into the compartment as the arcuate back wall 120.

In the depicted embodiment, the back wall 120 includes a first rib 128 defined thereon that extends transversely from the wall 120. As shown in the various figures, each elongated tab 124 is biased against a respective first rib 128 and slides against the rib 128 as the pivotal door 118 is moved between the fully closed and fully open positions. The first rib 128 has a minimal thickness and presents a minimal frictional contact surface against the elongated tab 124.

In certain embodiments, the first rib 128 may be flanked by a pair of spaced-apart second ribs 130 that extend transversely from the back wall 120 of the door 118 into the compartment 108 beyond the first rib 128. These second ribs 130 are spaced-apart such that the elongated tab 124 slides against the first rib 128 between the second ribs 130, as particularly seen in FIG. 6. The second ribs 130 may have a shape and length so as to be coplanar with the elongated tab 124 along at least an upper portion of the elongated tab 124, as particularly seen in FIGS. 4 and 8. This configuration of the second ribs 130 in conjunction with the elongated tab 124 and first rib 128 provides an essentially uninterrupted surface spanning across the hinge area as the pivotal door 118 is opened and closed, which eases loading of the ticket books. Very little care or attention is needed when closing the door 118 after loading the ticket book into the bin 12. Also, initial ticket book location in the bin 12 is not critical, as the door 118 configuration pushes the ticket book into the bin 12 as the door is closed while preventing pinching of tickets in the hinge area.

It should be understood that the present invention encompasses any manner of lottery ticket dispenser array 10 having one or more of the dispenser bins 100 as embodied herein.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser bin, comprising:

a housing having a front side that faces a purchaser in operational use of the dispenser array, an opposite back side, and an internal space defining one or more compartments for receipt of a supply of interconnected lottery tickets;

each compartment comprising an electronic drive mechanism that dispenses the lottery tickets through a dispensing slot in the back side;

a pivotal door configured on the housing and defining the back side, the pivotal door movable between a fully closed position and a fully open position relative to the housing, the pivotal door further comprising:

a back wall;

a bottom frame mounted to the housing;

one or more spring-loaded, elongated tabs pivotally mounted to the bottom frame, the elongated tab extending transversely from the bottom frame and biased against the back wall, the elongated tab comprising a length so as to be continuously engaged against the back wall as the pivotal door moves between the fully open and fully closed positions; and wherein the elongated tab defines a bridge that prevents the lottery tickets from moving into a hinge area between the housing and the pivotal door.

2. The lottery ticket dispenser bin as in claim 1, further comprising a plurality of the elongated tabs spaced apart along the bottom frame.

3. The lottery ticket dispenser bin as in claim 1, wherein the bottom frame comprises arms at opposite ends thereof, the arms releasably engaging with the housing to mount the bottom frame to the housing.

4. The lottery ticket dispenser bin as in claim 1, wherein in the fully closed position of the pivotal door, the elongated tab assumes a substantially vertical position within the housing.

5. The lottery ticket dispenser bin as in claim 1, wherein the back wall comprises a first rib defined thereon, the elongated tab biased against the first rib.

6. The lottery ticket dispenser bin as in claim 1, wherein the pivotal door extends across two adjacent compartments and includes at least one of the elongated tabs configured with each compartment.

7. A lottery ticket dispenser array, comprising a plurality of the dispenser bins in accordance with claim 1.

8. The lottery ticket dispenser bin as in claim 5, wherein the first rib is flanked by a pair of second ribs that extend transversely from the back wall beyond the first rib, the pair of second ribs spaced apart such that the elongated tab slides against the first rib between the second ribs.

9. The lottery ticket dispenser bin as in claim 8, wherein in the fully closed position of the pivotal door, the elongated tab is biased against the first rib and assumes a substantially vertical position within the housing, and the second ribs are coplanar with the elongated tab along at least an upper portion of the elongated tab.

* * * * *